US011454396B1

(12) United States Patent
Boardman et al.

(10) Patent No.: US 11,454,396 B1
(45) Date of Patent: Sep. 27, 2022

(54) FUEL INJECTOR AND PRE-MIXER SYSTEM FOR A BURNER ARRAY

(71) Applicant: General Electric Company, Schenectady, NY (US)

(72) Inventors: Gregory A. Boardman, Owens Cross Roads, AL (US); Vishal Sanjay Kediya, Karnataka (IN); Pradeep Naik, Karnataka (IN); Jeffrey M. Martini, Liberty Township, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/340,614

(22) Filed: Jun. 7, 2021

(51) Int. Cl.
*F23R 3/14* (2006.01)
*F23R 3/28* (2006.01)
*F23C 7/00* (2006.01)

(52) U.S. Cl.
CPC ..... *F23R 3/14* (2013.01); *F23R 3/286* (2013.01); *F23C 7/004* (2013.01); *F23R 2900/00002* (2013.01)

(58) Field of Classification Search
CPC .. F23R 3/14; F23R 3/286; F23D 14/62; F23D 14/64; F23D 11/40
See application file for complete search history.

(56) References Cited

U.S. PATENT DOCUMENTS 5,351,477 A * 10/1994 Joshi ..... F23D 17/002 60/737
5,675,971 A * 10/1997 Angel ..... F23R 3/286 60/737
5,863,195 A * 1/1999 Feldermann ..... F23D 11/40 431/12
6,141,967 A * 11/2000 Angel ..... F23R 3/14 60/737
6,880,340 B2 * 4/2005 Saitoh ..... F23R 3/14 60/737
8,186,166 B2 5/2012 Varatharajan et al.
8,276,385 B2 10/2012 Zuo et al.
8,322,143 B2 12/2012 Uhm et al.
8,424,311 B2 4/2013 York et al.
8,539,773 B2 9/2013 Ziminsky et al.
9,134,023 B2 9/2015 Boardman et al.
(Continued)

FOREIGN PATENT DOCUMENTS

EP 0623786 A1 11/1994

*Primary Examiner* — William H Rodriguez
(74) *Attorney, Agent, or Firm* — Venable LLP; Peter T. Hrubiec; Michele V. Frank

(57) ABSTRACT

A fuel injector and mini-mixer system includes a mixing element tube configured to mix air and fuel prior to injecting the air and fuel into a combustor, an injector positioned within the mixing element tube, the injector being configured to inject a fluid into the mixing element tube, one or more air inlet slots positioned on one or more sides of the injector, one or more fuel injection holes configured to inject fuel into the mixing element tube, and one or more delta wing vortex generators positioned within an internal wall of the mixing element tube, the one or more delta wing vortex generators configured to generate a vortex pair that accelerates the mixing of air and fuel injected into the mixing element tube. Additional air slots can be provided downstream of the delta wing vortex generators to energize the vortex pair or lift fuel away to prevent flameholding.

20 Claims, 6 Drawing Sheets

(56) References Cited

U.S. PATENT DOCUMENTS

| | | | | |
|---|---|---|---|---|
| 9,528,444 | B2 * | 12/2016 | Westmoreland | F02C 7/22 |
| 9,557,061 | B2 | 1/2017 | Biagioli et al. | |
| 9,650,959 | B2 | 5/2017 | Boardman et al. | |
| 9,651,259 | B2 * | 5/2017 | Boardman | F23R 3/286 |
| 9,759,425 | B2 * | 9/2017 | Westmoreland | F23R 3/12 |
| 9,765,973 | B2 * | 9/2017 | Chila | F23R 3/10 |
| 10,082,294 | B2 | 9/2018 | Laster et al. | |
| 10,101,032 | B2 | 10/2018 | Abd El-Nabi et al. | |
| 10,295,190 | B2 | 5/2019 | Boardman et al. | |
| 10,352,569 | B2 | 7/2019 | Boardman et al. | |
| 10,415,832 | B2 | 9/2019 | Lee | |
| 10,502,425 | B2 | 12/2019 | Boardman et al. | |
| 2011/0000214 | A1 * | 1/2011 | Helmick | F23R 3/14 60/734 |
| 2014/0260315 | A1 * | 9/2014 | Westmoreland | F23R 3/286 60/737 |
| 2014/0338338 | A1 * | 11/2014 | Chila | F23D 14/62 60/737 |
| 2017/0298884 | A1 * | 10/2017 | Patel | F02M 61/16 |
| 2018/0128491 | A1 * | 5/2018 | Boardman | F23R 3/04 |
| 2018/0216828 | A1 | 8/2018 | Johansson et al. | |
| 2019/0154263 | A1 * | 5/2019 | Bothien | F23R 3/286 |
| 2020/0173662 | A1 * | 6/2020 | Boehm | F23R 3/283 |
| 2021/0010674 | A1 * | 1/2021 | Thariyan | F23R 3/14 |
| 2021/0207808 | A1 * | 7/2021 | Mishra | F23R 3/286 |

* cited by examiner

FUEL INJECTOR AND PRE-MIXER SYSTEM FOR A BURNER ARRAY

TECHNICAL FIELD

The present disclosure relates to a fuel injector and mini-mixer (or pre-mixer) system for a burner array of a combustor of a gas turbine engine.

BACKGROUND

Gas turbine engines may include a fuel injector and mini-mixer system having one or more mini-mixers. Such a fuel injector and mini-mixer system receives fuel and air, and then mixes the received fuel and air to generate a partially premixed fuel. The mini-mixer system then feeds the partially premixed fuel to a combustor of the gas turbine engine, for combusting the partially premixed fuel.

BRIEF SUMMARY

A fuel injector and mini-mixer system comprising: (a) a mixing element tube configured to mix air and fuel prior to injecting the air and fuel into a combustor, (b) an injector positioned within the mixing element tube, the injector being configured to inject a fluid into the mixing element tube, (c) one or more air inlet slots positioned on one or more sides of the injector, the one or more air inlet slots configured to inject air into the mixing element tube, (d) one or more fuel injection holes extending into the mixing element tube, the one or more fuel injection holes configured to inject fuel into the mixing element tube, and (e) one or more delta wing vortex generators positioned within an internal wall of the mixing element tube, the one or more delta wing vortex generators configured to generate a vortex pair that accelerates the mixing of the air and fuel injected into the mixing element tube.

A burner array comprising: (a) a plurality of fuel injector and mini-mixer systems, each fuel injector and mini-mixer system of the plurality of fuel injector and mini-mixer systems comprising: (i) a mixing element tube configured to mix air and fuel prior to injecting the air and fuel into a combustor, (ii) an injector positioned within the mixing element tube, the injector being configured to inject a fluid into the mixing element tube, (iii) one or more air inlet slots positioned on one or more sides of the injector, the one or more air inlet slots configured to inject air into the mixing element tube, (iv) one or more fuel injection holes extending into the mixing element tube, the one or more fuel injection holes configured to inject fuel into the mixing element tube, and (v) one or more delta wing vortex generators positioned within an internal wall of the mixing element tube, the one or more delta wing vortex generators configured to generate a vortex pair that accelerates the mixing of the air and fuel injected into the mixing element tube, and (b) a plate covering the plurality of fuel injector and mini-mixer systems.

A combustor comprising: (A) an internal wall and an external wall, the internal wall having a burner array, the burner array comprising: (a) a plurality of fuel injector and mini-mixer systems, each fuel injector and mini-mixer system of the plurality of fuel injector and mini-mixer systems comprising: (i) a mixing element tube configured to mix air and fuel prior to injecting the air and fuel into a combustor, (ii) an injector positioned within the mixing element tube, the injector being configured to inject a fluid into the mixing element tube, (iii) one or more air inlet slots positioned on one or more sides of the injector, the one or more air inlet slots configured to inject air into the mixing element tube, (iv) one or more fuel injection holes extending into the mixing element tube, the one or more fuel injection holes configured to inject fuel into the mixing element tube, and (v) one or more delta wing vortex generators positioned within an internal wall of the mixing element tube, the one or more delta wing vortex generators configured to generate a vortex pair that accelerates the mixing of the air and fuel injected into the mixing element tube, and (b) a plate covering the plurality of fuel injector and mini-mixer systems, and (B) a chamber configured to combust the air and fuel injected into the combustor via the burner array.

Additional features, advantages, and embodiments of the present disclosure are set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Various embodiments are discussed in detail below. While specific embodiments are discussed, this is done for illustration purposes only. A person skilled in the relevant art will recognize that other components and configurations may be used without departing from the spirit and scope of the present disclosure.

The present disclosure relates to a fuel injector and mini-mixer system for a burner array of a combustor of a gas turbine engine. In particular, the present disclosure provides a fuel injector and mini-mixer system that sufficiently mixes air with hydrogen fuel (or high-hydrogen fuel mixtures) before combustion occurs in a combustor of a gas turbine engine.

Depending upon the type of fuel being used with a combustor, a mini-mixer system and/or the type or structure of fuel injectors/nozzles used with the combustor can differ. For example, fuels having a high hydrogen content can result in relatively high flame speed as compared to, for example, natural gas, and the resulting high flame speed can lead to flashback in the combustor of the gas turbine engine. Thus, the fuel injector and mini-mixer system of the instant disclosure provides various features to prevent such flashback and to improve mixing of fuel and air before the mixture of fuel/air reaches flame front to reduce NOx emission.

Figure 1:
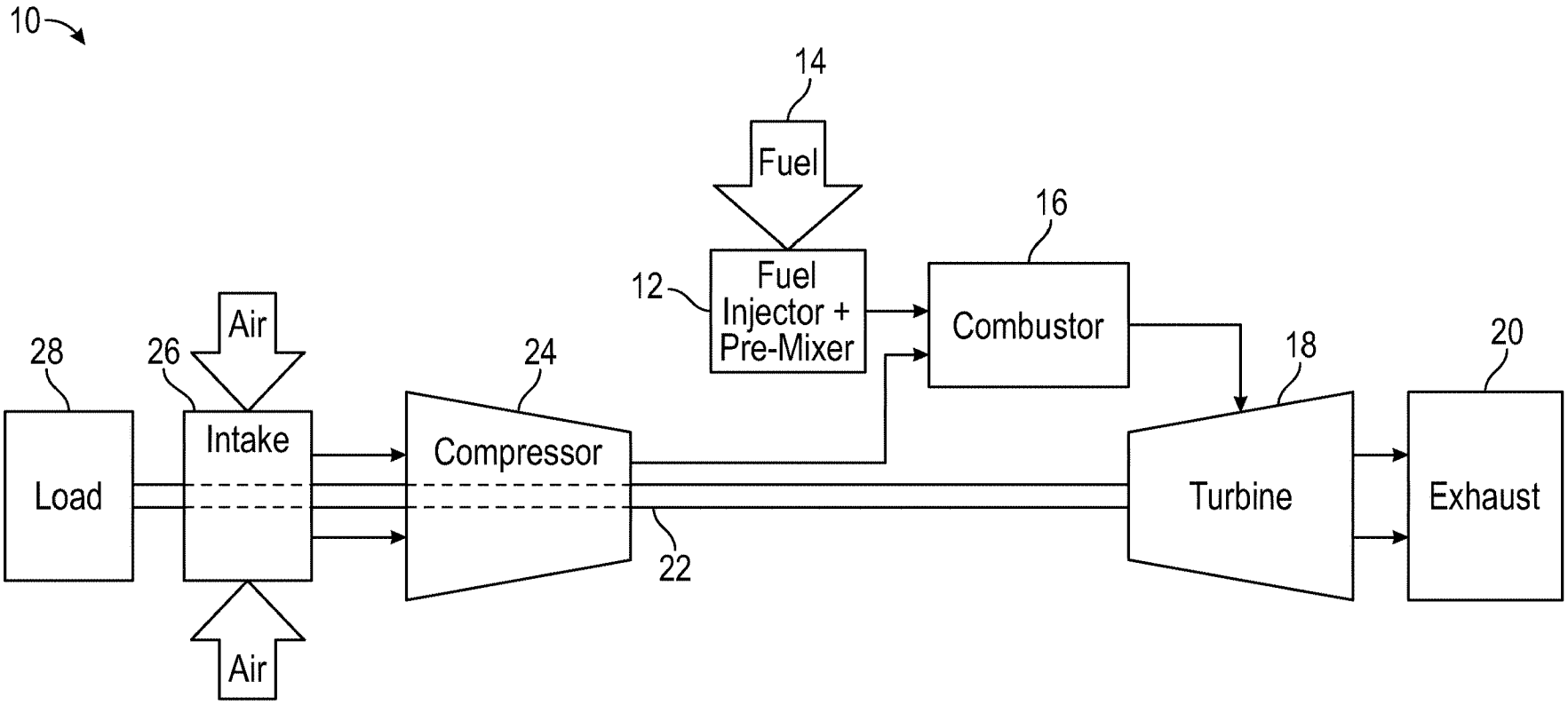
FIG. 1 is a block diagram of a gas turbine engine having a fuel injector and mini-mixer system fluidly coupled with a combustor, according to an embodiment of the present disclosure.

FIG. 1 is a block diagram of an embodiment of a turbine system 10. The turbine system 10 (e.g., a gas turbine engine) may employ an injector/mini-mixer assembly with one or more fuel injector and mini-mixer systems 12 configured to sufficiently mix air with fuel before combustion occurs in a combustor 16 of the turbine system or engine 10. For example, the fuel injector and mini-mixer system 12 may include a plurality of fuel injector and mini-mixer systems 12 arranged to create a burner array (see, e.g., FIG. 2). The turbine system 10 may use liquid or gaseous fuel, such as natural gas and/or a hydrogen fuel (or high-hydrogen fuel mixtures) to drive the turbine system 10. As depicted, the fuel injector and mini-mixer system 12 intakes a fuel from a fuel supply 14, mixes the fuel with air to provide an air-fuel mixture, and distributes the air-fuel mixture into the combustor 16 in a suitable ratio for combustion, with consideration of one or more characteristic factors such as, e.g., emissions, fuel consumption, and/or power output. The turbine system 10 may include one or more fuel injector and mini-mixer systems 12 located inside one or more combustors 16. The air-fuel mixture combusts in a chamber within the combustor 16, thereby creating hot pressurized exhaust gases. The combustor 16 directs the exhaust gases through a turbine 18 toward an exhaust outlet 20. As the exhaust gases pass through the turbine 18, the gases force turbine blades to rotate a shaft 22 along an axis of the turbine system 10. As illustrated, the shaft 22 may be connected to various components of the turbine system 10, including, e.g., a compressor 24. The compressor 24 also includes blades coupled to the shaft 22. As the shaft 22 rotates, the blades within the compressor 24 also rotate, thereby compressing air from an air intake 26 through the compressor 24 and into the fuel injector and mini-mixer system 12 and/or the combustor 16. The shaft 22 may also be connected to a load 28, which may be a vehicle or a stationary load, such as, e.g., an electrical generator in a power plant or a propeller on an aircraft, for example. The load 28 may include any suitable device capable of being powered by the rotational output of the turbine system 10, including, for example, a fan.

Figure 2:
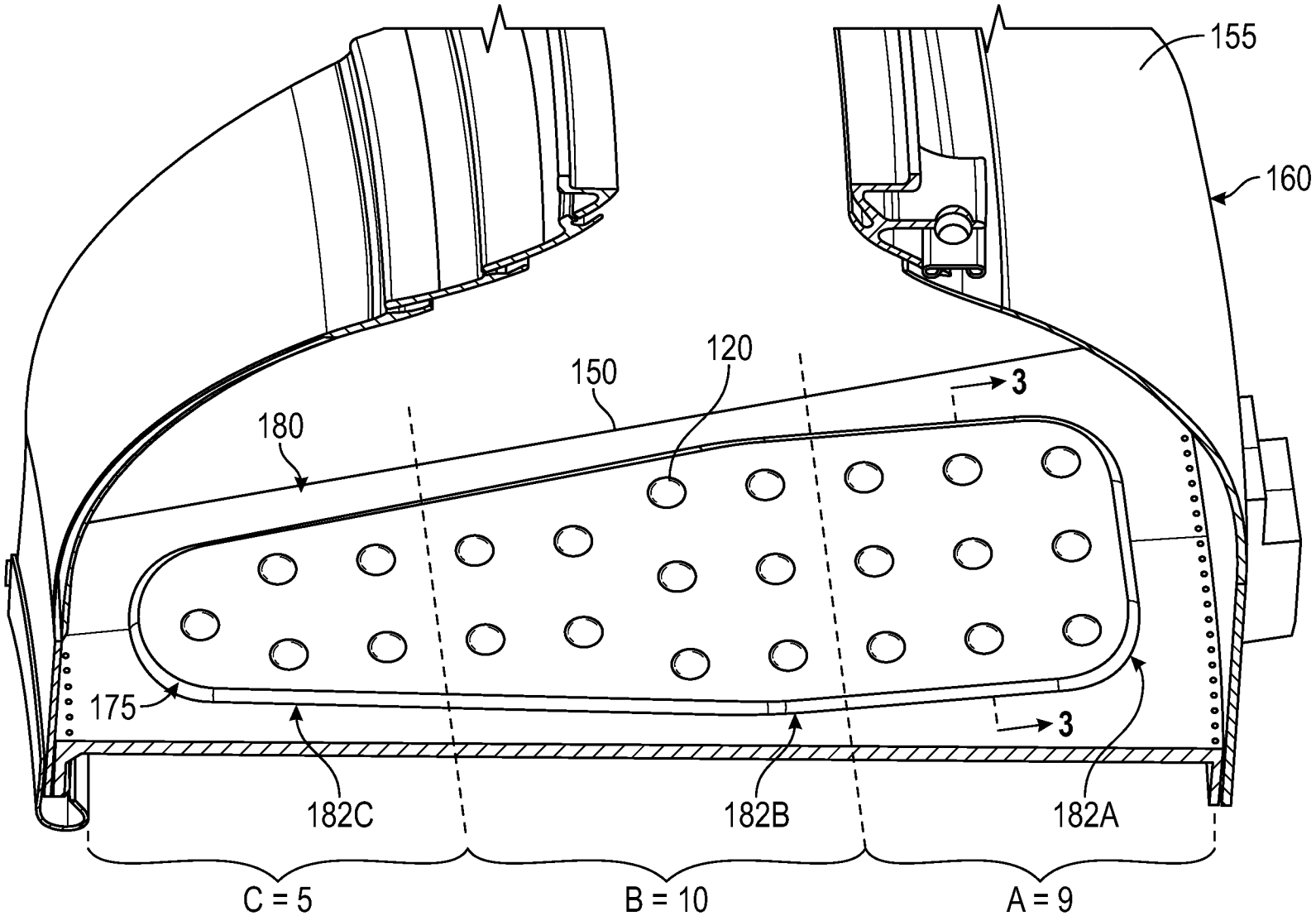
FIG. 2 illustrates a partial, cross-sectional view of a wall of a combustor having a burner array that includes a plurality of fuel injector and mini-mixer systems, according to an embodiment of the present disclosure.

FIG. 2 illustrates a partial, cross-sectional view of a combustor having a burner array that includes a plurality of fuel injector and mini-mixer systems according to one embodiment of the present disclosure. In particular, as shown in FIG. 2, a burner array 180 is provided along an internal wall 150 of a combustor 160. The burner array 180 includes a plurality of fuel injector and mini-mixer systems 120 (described in further detail below) that are covered by a plate 175. In the embodiment of FIG. 2, the burner array 180 includes three distinct arrays (i.e., 182A, 182B, and 182C) comprising a total of twenty-four (24) fuel injector and mini-mixer systems 120. The first array 182A of the burner array 180 includes nine fuel injector and mini-mixer systems 120 (A=9) that are equally spaced and arranged from each other in a square configuration. The second array 182B of the burner array 180 includes ten fuel injector and mini-mixer systems 120 (B=10) that are arranged in a desired configuration relative to each other. The burner array 180 further includes a third array 182C that includes five fuel injector and mini-mixer systems 120 (C=5) that are arranged in yet another, different configuration relative to each other. Depending upon the fuel injection desired and/or required for injecting partially pre-mixed air and fuel into the combustor 160, the number and arrangement of the arrays (e.g., 182A, 182B, and 182C) and the fuel injector and mini-mixer systems 120 of the burner array 180 can be selected. As further shown in FIG. 2, the combustor 160 further includes a mini-mixer assembly (not shown) which is mounted on a combustor casing 155. The mini-mixer assembly has a fuel circuit (not shown) and an air circuit (not shown) through which fuel and air is directed into the plurality of fuel injector and mini-mixer systems 120 of the burner array 180. According to one embodiment, each of the arrays (e.g., 182A, 182B, and 182C) of the burner array 180 is independently controlled. According to one embodiment, a first and/or a second fuel circuit can be provided per array or zone (e.g., 182A, 182B, and 182C) for starting different fuel types, dynamics abatement, and/or NOx abatement.

Figure 3:
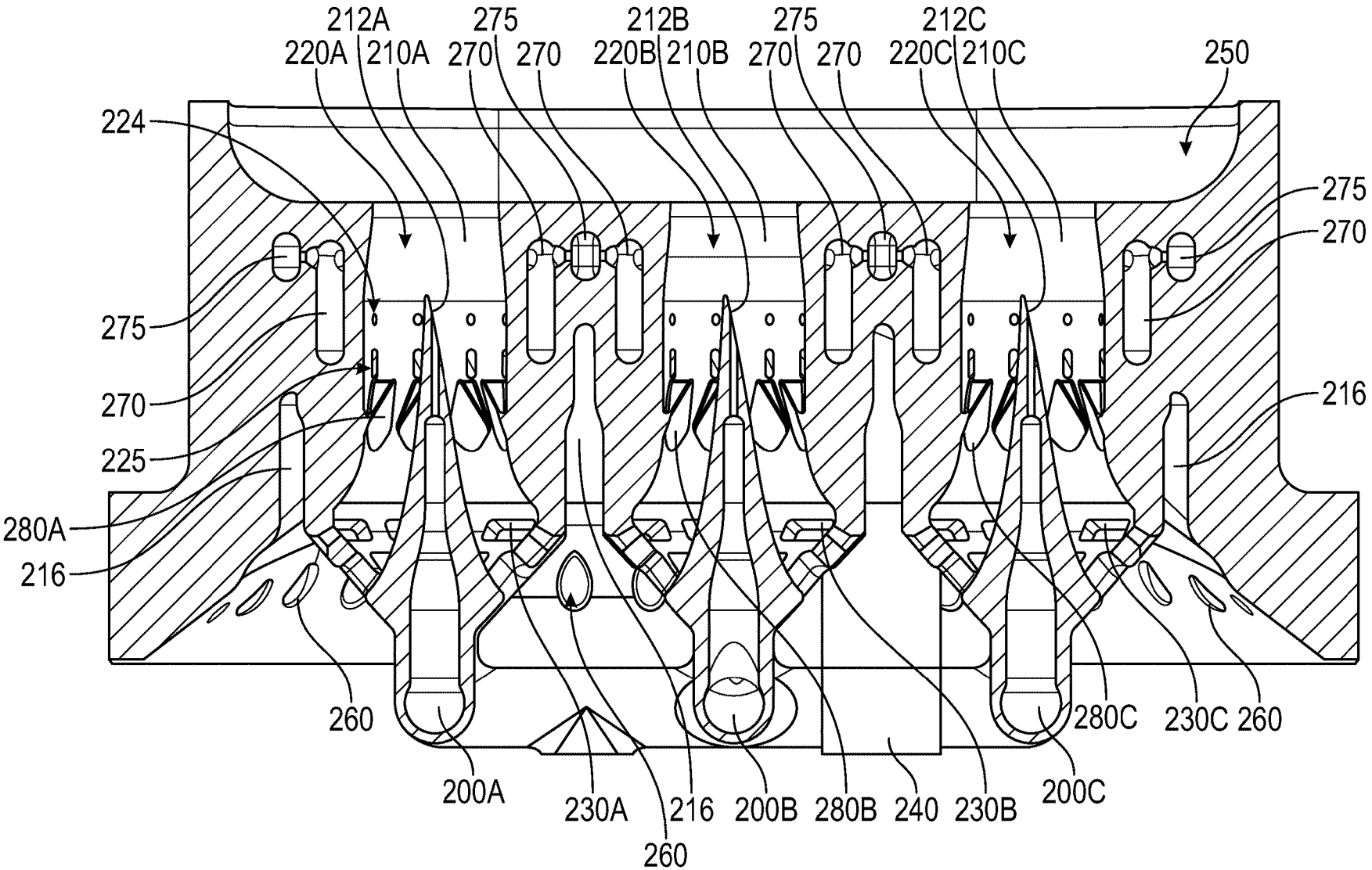
FIG. 3 illustrates a cross-sectional view of the burner array shown in FIG. 2 taken along line 3-3 in FIG. 2, according to an embodiment of the present disclosure.

FIG. 3 illustrates a cross-sectional view of three fuel injector and mini-mixer systems 120 of the burner array 180 shown in FIG. 2 taken along line 3-3 in FIG. 2, according to an embodiment of the present disclosure. As shown in FIG. 3, the three fuel injector and mini-mixer systems (i.e., 220A, 220B, and 220C) each includes an injector (i.e., 200A, 200B, and 200C, respectively) for injecting a fluid (e.g., fuel 1, fuel 2, a blend of fuel 1 and fuel 2, and/or a diluent, e.g., water) into a cylindrical mixing-element tube (i.e., 210A, 210B, and 210C, respectively) and/or a combustor (see, e.g., combustor 160 of FIG. 2) for combustion. Fuel, such as, e.g., hydrogen fuel (or high-hydrogen fuel mixtures), is injected into each of the cylindrical mixing-element tubes (i.e., 210A, 210B, and 210C) where it is mixed with air, which is fed into each of the cylindrical mixing-element tubes (i.e., 210A, 210B, and 210C), to partially pre-mix the air and fuel prior to injecting such air and fuel mixture into a combustor for combustion. The fuel is injected into each of the cylindrical mixing-element tubes (i.e., 210A, 210B, and 210C) via respective fuel injection holes (see, e.g., hole 224, which is described in further detail below). The fuel is distributed to the respective fuel injection holes (see, e.g., hole 224) using an annular main fuel distributor gallery 270 that surrounds each of the cylindrical mixing-element tubes (i.e., 210A, 210B, and 210C). Each of the annular main fuel distributor galleries 270 is coupled to a main or common fuel inlet tube 240, which feeds fuel into the annular main fuel distributor galleries 270 for distributing to the respective fuel injection holes (see, e.g., hole 224). According to one embodiment, the fuel that exits the main or common fuel inlet tube 240 comprises 100% hydrogen ($H_2$) or blends of $H_2$ fuel or conventional fuel, such as, e.g., natural gas fuel. The main fuel inlet tube 240 is connected to a fuel main (not shown) via a fuel circuit channel 275. The fuel circuit channel 275 is then connected to main fuel distribution galleries 270 using tangential feed holes (not shown). The fuel circuit channel 275 is around an aft plate 250, which helps to take away heat from the combustor side (i.e., above aft plate 250). Tangential holes (not shown), which are present between the fuel circuit channel 275 and the main fuel distribution galleries 270, help to attain the same fuel distribution between respective fuel injection holes 224. Air is fed into each of the cylindrical mixing-element tubes (i.e., 210A, 210B, and 210C) via respective air inlet slots (i.e., 230A, 230B, and 230C, respectively) that respectively surround and/or are positioned around (e.g., on one or more sides) each of the injectors (i.e., 200A, 200B, and 200C). There can be multiple rows of air inlet slots (i.e., 230A, 230B, and 230C) on a conic surface that introduces air into the fuel injector and mini-mixer systems (i.e., 220A, 220B, and 220C) at a location that is forward to (i.e., upstream of) the respective fuel injection holes 224. According to one embodiment, the air that is fed into each of the cylindrical mixing-element tubes (i.e., 210A, 210B, and 210C) via respective air inlet slots (i.e., 230A, 230B, and 230C, respectively) comprises compressor discharge air (see, e.g., compressor 24 of FIG. 1). Air is also fed into each of the cylindrical mixing-element tubes (i.e., 210A, 210B, and 210C) via respective enhancement air slots (see, e.g., slot 225, which is described in further detail below). The air is fed into the enhancement air slots (see, e.g., slot 225) via a recessed region 216 that is positioned around the cylindrical mixing-element tubes (i.e., 210A, 210B, and 210C). Moreover, within each of the cylindrical mixing-element tubes (i.e., 210A, 210B, and 210C), a plurality of delta-wing vortex generators (i.e., 280A, 280B, and 280C, respectively) is included to aid in the mixing of the air and fuel to provide an air-fuel mixture prior to injecting such air-fuel mixture into the combustor (which will be described in further detail below). According to one embodiment, eight delta-wing vortex generators (e.g., 280A, 280B, and 280C) are included within each of the cylindrical mixing-element tubes (i.e., 210A, 210B, and 210C). However, any number of delta-wing vortex generators (e.g., 280A, 280B, and 280C) can be included to achieve desired fuel-air mixing within the fuel injector and mini-mixer systems (i.e., 220A, 220B, and 220C).

As shown in FIG. 3, each of the cylindrical mixing-element tubes (i.e., 210A, 210B, and 210C) tapers and/or converges inwardly to a distal end that is positioned at the aft plate 250 (or burner depression region), which is covered by a plate of the burner array that is disposed within an internal wall of a combustor (see, e.g., plate 175 of burner array 180 that is disposed within the internal wall 150 of the combustor 160 of FIG. 2). According to one embodiment, each of the cylindrical mixing-element tubes (i.e., 210A, 210B, and 210C) tapers and/or converges inwardly to allow for at least 10% flow area contraction of pre-mixed air and fuel that is to be injected into the combustor. This tapering of the cylindrical mixing-element tubes, which results in contraction of the flow area, helps to prevent flashback in the combustor due to high flame speeds that generally result with fuels having a high hydrogen content.

Figure 5:
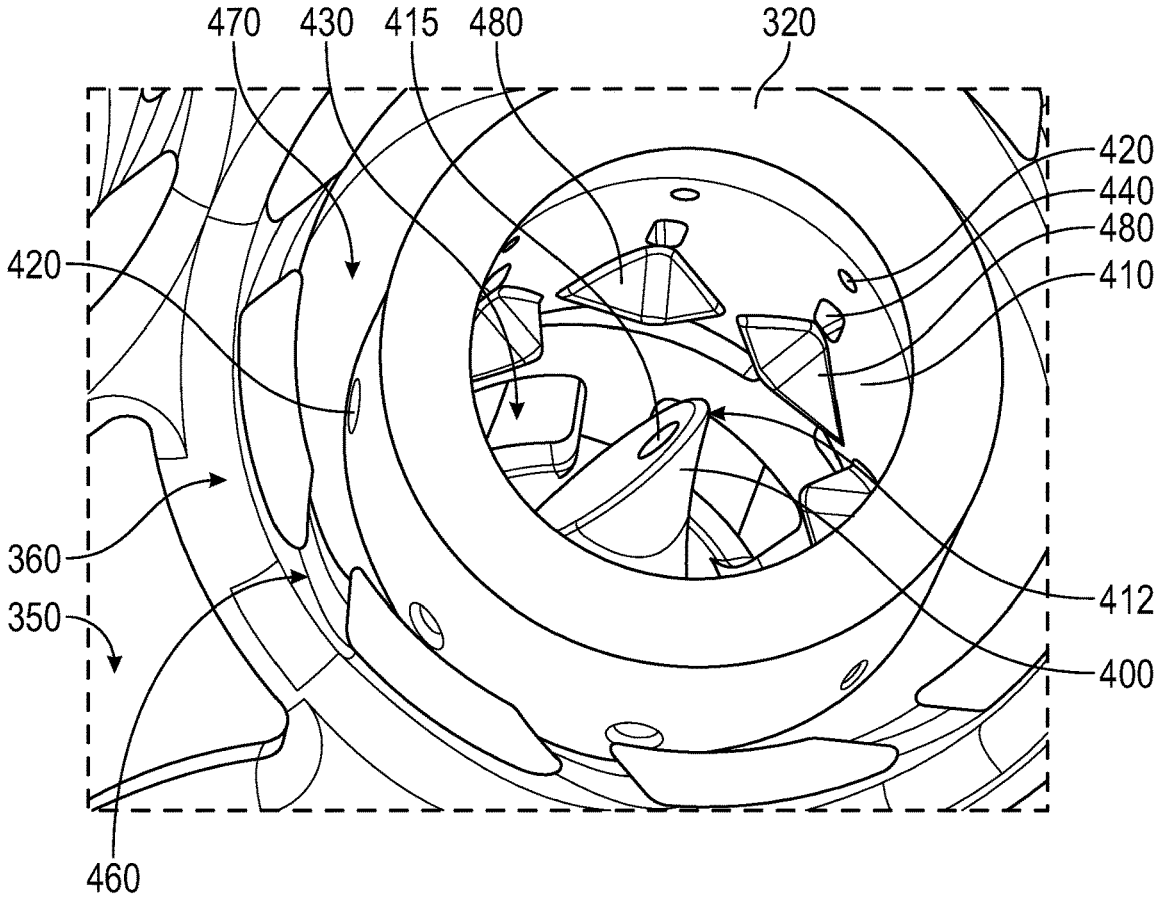
FIG. 5 illustrates an enlarged, partial view of one fuel injector and mini-mixer system of the burner array illustrated in FIG. 4, according to an embodiment of the present disclosure.

As further shown in FIG. 3, each of the injectors (i.e., 200A, 200B, and 200C) includes a tip portion (i.e., 212A, 212B, and 212C, respectively) through which a fluid (e.g., fuel 1 (e.g., natural gas and/or $H_2$ fuel), fuel 2 (e.g., natural gas and/or $H_2$ fuel), a blend of fuel 1 and fuel 2, and/or a diluent, e.g., water) is injected. This tip portion (i.e., 212A, 212B, and 212C) of the injectors (i.e., 200A, 200B, and 200C), which is further shown in FIG. 5, is cut/shaped into an oblique angle (e.g., around 45°), which prevents a low velocity of the fluid getting developed closer to the tip, and aids in the prevention of flashback in the combustor due to high flame speeds that generally result with fuels having a high hydrogen content. According to one embodiment, the tip portion (i.e., 212A, 212B, and 212C) can have a different fuel manifold and/or a different inlet feeding fuel to the center of the respective injectors (i.e., 200A, 200B, and 200C), which is different from the fuel manifold and/or the inlet feeding fuel to the fuel injection holes 224. Thus, according to one embodiment, the fuel directed through the center fuel orifice or tip portion (212A, 212B, and 212C) and the main fuel injection holes 224 can be independently controlled.

Each of the fuel injector and mini-mixer systems (i.e., 220A, 220B, and 220C) can be surrounded by a plurality of cooling holes 260 to control the temperature of the fuel injector and mini-mixer systems (i.e., 220A, 220B, and 220C), including the aft plate 250, and the temperatures of downstream components of the combustor during use (see, also, e.g., FIG. 4, which is described below). Such cooling holes 260 allow for maintaining a desired temperature of the aft plate 250 of the fuel injector and mini-mixer systems (i.e., 220A, 220B, and 220C), such that the aft plate 250 of the fuel injector and mini-mixer systems (i.e., 220A, 220B, and 220C) and any downstream combustor components associated with a combustor liner do not overheat during engine operation.

Figure 4:
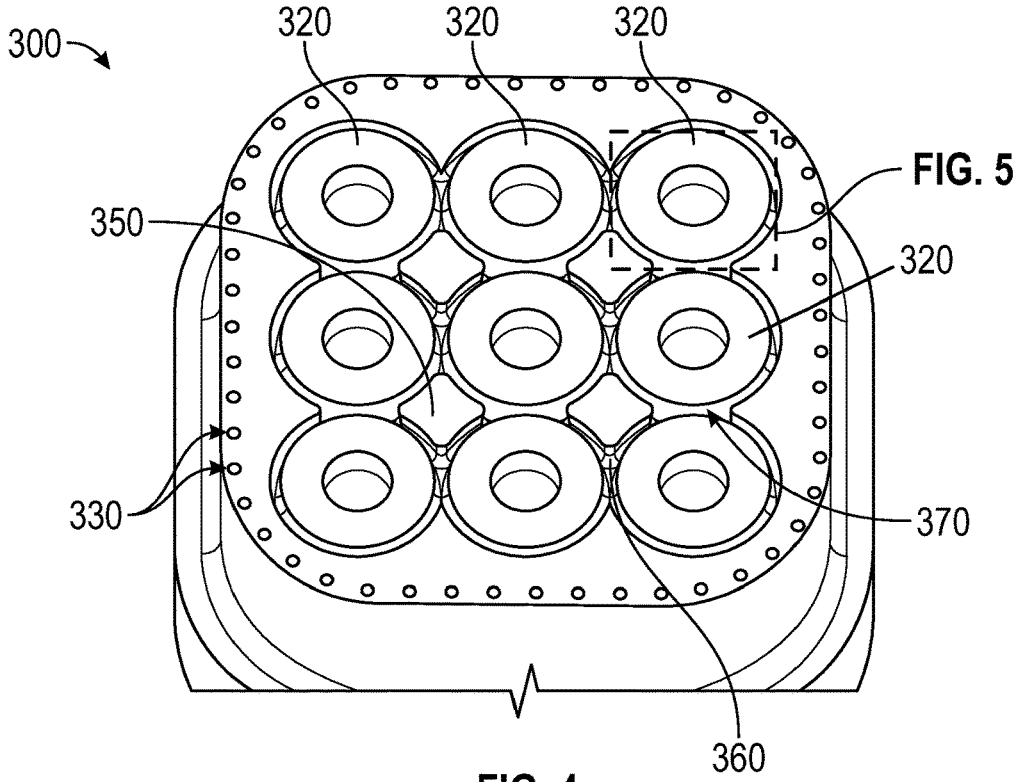
FIG. 4 illustrates a burner array that includes a plurality of fuel injector and mini-mixer systems, according to an embodiment of the present disclosure.

FIG. 4 illustrates a burner array 300 that includes a plurality of fuel injector and mini-mixer systems, according to an embodiment of the present disclosure, in which a plate (e.g., aft plate) that covers the burner array has been removed (see, e.g., aft plate 250 of FIG. 3). As shown in FIG. 4, the burner array 300 includes nine fuel injector and mini-mixer systems 320 (see also, e.g., first array 182A of the burner array 180 of FIG. 2 that includes nine fuel injector and mini-mixer systems 120 (A=9)). A plurality of main fuel inlet tubes or structures 350 (see also, e.g., main fuel inlet tube 240 of FIG. 3) is provided between each of the fuel injector and mini-mixer systems 320. These main fuel inlet tubes or structures 350 feed fuel into channels 360, which in turn feed the fuel into annular main fuel distributor galleries 370 through tangential holes (not shown). Fuel distributor galleries 370 (see also, e.g., annular main fuel distributor galleries 270 of FIG. 3 and annular main fuel distributor galleries 470 of FIG. 5) surround each of the fuel injector and mini-mixer systems 320 and distribute fuel to respective fuel injection holes (see, e.g., fuel injection holes 224 of FIG. 3 and fuel injection holes 420 of FIG. 5) and into the fuel injector and mini-mixer systems 320. The burner array 300 also includes a plurality of cooling holes 330 along the perimeter of the burner array 300. These cooling holes 330 allow for maintaining a desired temperature of the aft plate (see, e.g., aft plate 250 of FIG. 3) of the fuel injector and mini-mixer systems 320 and any downstream combustor components, such that the fuel injector and mini-mixer systems 320 do not overheat during operation of engine. According to one embodiment, the internal channels 360, which feed fuel from the main fuel inlet tubes or structures 350 and into the annular main fuel distributor galleries 370, help to cool the plate (e.g., aft plate) that covers the burner array (see, e.g., aft plate 250 of FIG. 3) via the flow of fuel through the channels 360. The plate of the fuel injector and mini-mixer systems 320 can be a flat plate (see, e.g., plate 175 of burner array 180 that is disposed within the internal wall 150 of the combustor 160 of FIG. 2) or the plate can have a depression (see, e.g., aft plate 250 of FIG. 3).

According to one embodiment, an aft plate having a depression (see, e.g., aft plate 250 of FIG. 3) can achieve better flame stability.

FIG. 5 illustrates an enlarged, partial view of one of the fuel injector and mini-mixer systems 320 of the burner array 300 illustrated in FIG. 4. In particular, as shown in FIG. 5, the fuel injector and mini-mixer system 320 includes a cylindrical mixing-element tube 410 (see also, e.g., cylindrical mixing-element tubes 210A, 210B, and 210C of FIG. 3) into which air and fuel are injected for pre-mixing prior to injecting the pre-mixed air-fuel mixture into a combustor. The fuel injector and mini-mixer system 320 further includes a plurality of fuel injection holes 420 through which fuel is injected into the cylindrical mixing-element tube 410. As previously discussed, fuel is distributed to the plurality of fuel injection holes 420 via an annular main fuel distributor gallery 470 that surrounds each of the fuel injector and mini-mixer systems 320. Fuel enters the annular main fuel distributor gallery 470 via a gallery inlet 460 that connects to a channel 360, which delivers fuel from the main fuel inlet tubes or structures 350, as discussed above. According to one embodiment, as an example, eight fuel injection holes 420 are included within the cylindrical mixing-element tube 410. According to another embodiment, any number of fuel injection holes 420 can be included within the cylindrical mixing-element tube 410, including, e.g., any multiple number and/or any number less than eight. According to another embodiment, each of the fuel injection holes 420 can be anywhere between 20° to 90°, with respect to an internal surface of the cylindrical mixing-element tube 410.

As further shown in FIG. 5, the fuel injector and mini-mixer system 320 also includes a plurality of air inlet slots 430 that feed air into the cylindrical mixing-element tube 410. These air inlet slots 430 surround (i.e., are positioned around and/or on one or more sides) an injector 400 that is centered within the cylindrical mixing-element tube 410 and injects a fluid (e.g., fuel 1, fuel 2, a blend of fuel 1 and fuel 2, and/or a diluent, e.g., water) into the cylindrical mixing-element tube 410 and/or a combustor (not shown) for combustion. As discussed above, the central injector 400 includes a tip portion 412 through which the fluid is ejected through an outlet 415. This tip portion 412 of the injector 400 is cut/shaped into an oblique angle (e.g., an angle from 30° to 60° and/or an angle of, e.g., 30°, 45°, or 60°), which prevents a low velocity of fluid from getting developed on this tip portion 412 of the central injector 400 and aids in the prevention of flashback in the fuel injector and mini-mixer system 320 due to high flame speeds that generally result with fuels having a high hydrogen content. According to one embodiment, the outlet 415 of the injector 400 comprises a single centered hole. Air is also fed into the cylindrical mixing-element tube 410 via a plurality of enhancement air slots 440, which will be described in further detail below. According to one embodiment, as an example, eight enhancement air slots 440 are included within the cylindrical mixing-element tube 410. According to another embodiment, any number of enhancement air slots 440 can be included within the cylindrical mixing-element tube 410, including, e.g., any multiple number and/or any number less than eight. According to another embodiment, each of the enhancement air slots 440 is at an angle that can range from, e.g., 30° to 60°, with respect to an internal surface of the cylindrical mixing-element tube 410. Moreover, as discussed above, the fuel injector and mini-mixer system 320 further includes a plurality of delta-wing vortex generators 480 within the cylindrical mixing-element tube 410 to aid in the mixing of air and fuel to provide an air-fuel mixture prior to injecting such air-fuel mixture into the combustor (which will be described in further detail below). According to one embodiment, as an example, eight delta-wing vortex generators 480 are included within the cylindrical mixing-element tube 410. According to another embodiment, any number of delta-wing vortex generators 480 can be included within the cylindrical mixing-element tube 410, including, e.g., any multiple number and/or any number less than eight. According to an embodiment, each of the delta-wing vortex generators 480 comprises a tetrahedron shape, but any other shape is possible.

Figure 6A:
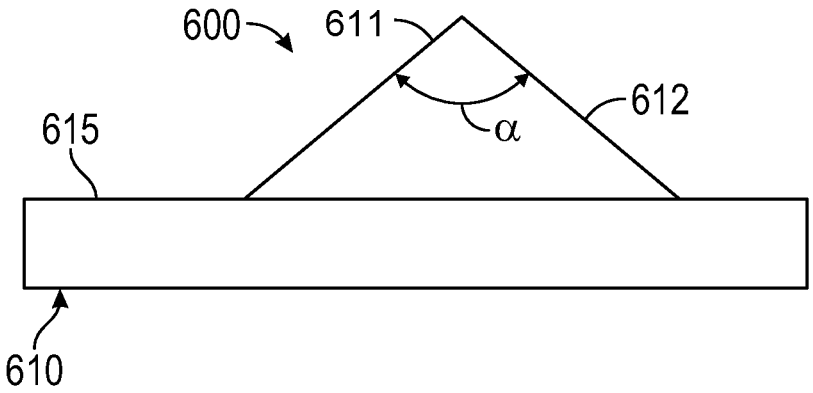
FIG. 6A illustrates a front view of a delta wing vortex generator positioned along a wall of a fuel injector and mini-mixer system, according to an embodiment of the present disclosure.
Figure 6B:
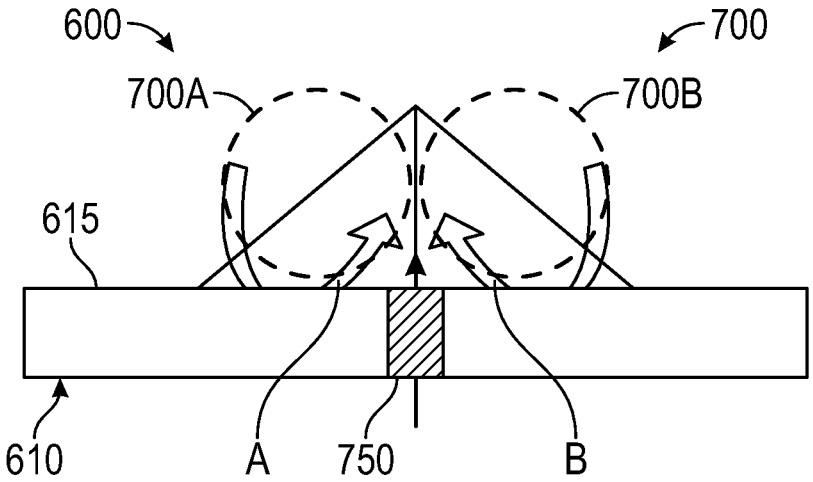
FIG. 6B illustrates a rear view of the delta wing vortex generator illustrated in FIG. 6A, in which a vortex pair is created along the delta wing vortex generator, according to an embodiment of the present disclosure.
Figure 6C:
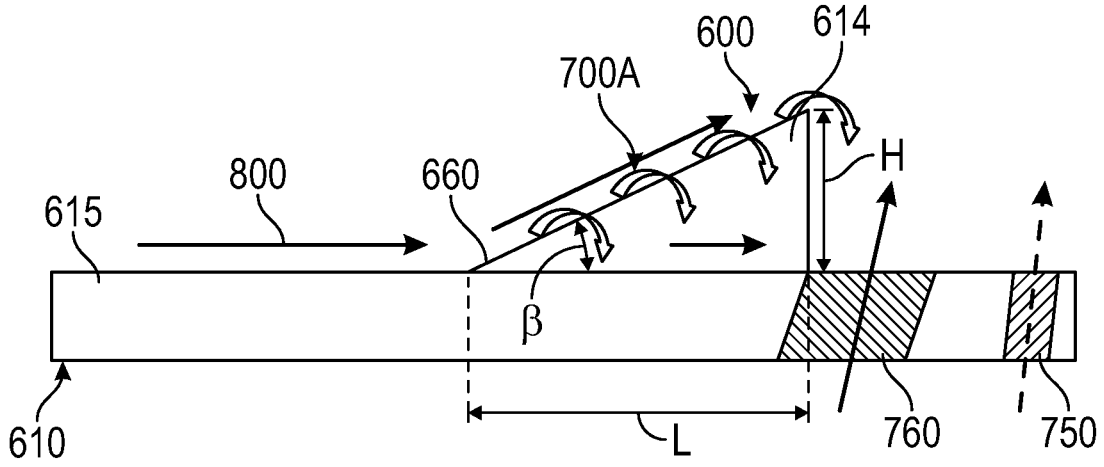
FIG. 6C illustrates a side view of the delta wing vortex generator illustrated in FIG. 6A, according to an embodiment of the present disclosure.

FIGS. 6A to 6C illustrate a delta wing vortex generator 600 positioned along a wall of a fuel injector and mini-mixer system (see, e.g., fuel injector and mini-mixer system 320 of FIGS. 4 and 5), according to an embodiment of the present disclosure. As shown in FIG. 6A, a delta wing vortex generator 600 is positioned along an internal wall 615 of a cylindrical mixing-element tube 610 (see, e.g., cylindrical mixing-element tube 410 of FIG. 5). As shown in the front view of FIG. 6A, the delta wing vortex generator 600 includes a first side 611 and a second side 612 that are positioned at an angle $\alpha$ relative to each other. According to one embodiment, the angle $\alpha$ is around 50°. According to another embodiment, the angle $\alpha$ is from 20° to 120°.

FIG. 6B illustrates a rear view (or aft view) of the delta wing vortex generator 600 illustrated in FIG. 6A. As shown in FIG. 6B, a vortex pair 700 is created along the delta wing vortex generator 600 in an area that is behind (i.e., aft) the delta wing vortex generator 600 and into which fuel is injected via a fuel injection hole 750 into the cylindrical mixing-element tube 610. The vortex pair 700 includes (i) a first vortex 700A that rotates in one direction (see, e.g., counter-clockwise direction labeled as A in FIG. 6B) and (ii) a second vortex 700B that rotates in a second and opposite direction (see, e.g., clockwise direction labeled as B in FIG. 6B). This vortex pair 700 is created at each fuel injection point (e.g., fuel injection hole 750). The vortex pair 700 lifts fuel away from the internal wall 615 of the cylindrical mixing-element tube 610, which accelerates the mixing of air and fuel that is injected into the cylindrical mixing-element tube 610. Moreover, the vortex pair 700 creates mixing without high turbulence, which can be critical when using hydrogen fuel (or high-hydrogen fuel mixtures). The vortex pair 700 also keeps fuel away from the internal wall 615 of the cylindrical mixing-element tube 610, which is critical when dealing with fuel like hydrogen and blends of hydrogen. In particular, as shown in the side view of FIG. 6C, air 800 that enters the cylindrical mixing-element tube 610 interacts with the delta wing vortex generator 600 that is positioned along the internal wall 615 of the cylindrical mixing-element tube 610. The air 800 contacts a front surface 660 of the delta wing vortex generator 600 that is positioned at an angle $\beta$ with respect to the internal wall 615 of the cylindrical mixing-element tube 610. According to one embodiment, the front surface 660 of the delta wing vortex generator 600 is positioned at an angle of about 25° relative to the internal wall 615 of the cylindrical mixing-element tube 610. According to another embodiment, the front surface 660 of the delta wing vortex generator 600 is positioned at an angle of 10° to 50° relative to the internal wall 615 of the cylindrical mixing-element tube 610. As the air 800 contacts this front surface 660 of the delta wing vortex generator 600, at least one vortex 700A of the vortex pair 700 is created as the air 800 flows over this front surface 660 of the delta wing vortex generator 600. The front surface 660 of the delta wing vortex generator 600 extends a distance L to a back surface 614 of the delta wing vortex generator 600, which extends a distance H from the internal wall 615 of the cylindrical mixing-element tube 610 and into the interior of the cylindrical mixing-element tube 610. According to one embodiment, the distance L (or length) of the delta wing vortex generator 600 is from 0.5 to three times the height (H) of the delta wing vortex generator 600. In an area behind (i.e., aft or downstream) the delta wing vortex generator 600, additional enhancement air is injected into the cylindrical mixing-element tube 610 via an enhancement air slot 760, along with fuel, which is injected via a fuel injection hole 750. According to one embodiment, this additional enhancement air is injected into the cylindrical mixing-element tube 610 via an enhancement air slot 760 that is positioned at an angle of 30° to 90° relative to the internal wall 615 of the cylindrical mixing-element tube 610. According to an embodiment, the enhancement air slot 760 is positioned at an angle of 60° relative to the internal wall 615 of the cylindrical mixing-element tube 610. According to another embodiment, the enhancement air slot 760 can be parallel to or positioned at an angle relative to the fuel injection hole 750. This additional/enhancement air energizes the vortex pair 700 to further accelerate the mixing of air and fuel that are injected into the cylindrical mixing-element tube 610, while also clearing away any recirculating wake downstream of the vortex generator 600. Thus, according to this embodiment, the configuration, structure (e.g., tetrahedron), and/or placement of the delta wing vortex generator 600 along the internal wall 615 of the cylindrical mixing-element tube 610, in combination with the enhancement air slot 760 that is positioned behind (e.g., aft or downstream) the delta wing vortex generator 600, creates and energizes the vortex pair 700 at each fuel injection point (e.g., fuel injection hole 750). As discussed above, this vortex pair 700 lifts fuel way from the internal wall 615 of the cylindrical mixing-element tube 610, which accelerates the mixing of fuel and air (e.g., air 800) that are injected into the cylindrical mixing-element tube 610. According to one embodiment, up to 90% mixing of air and fuel can occur before a flame front that is present within the combustor.

Figure 7A:
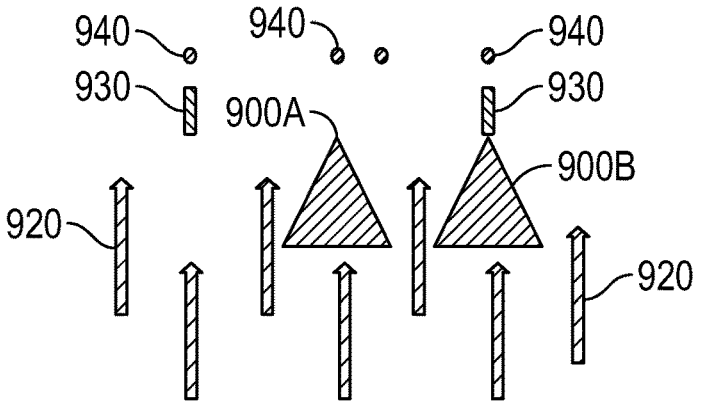
FIGS. 7A to 7C illustrate alternative positions for one or more delta wing vortex generators positioned along a wall of a fuel injector and mini-mixer system, according to various embodiments of the present disclosure.
Figure 7B:
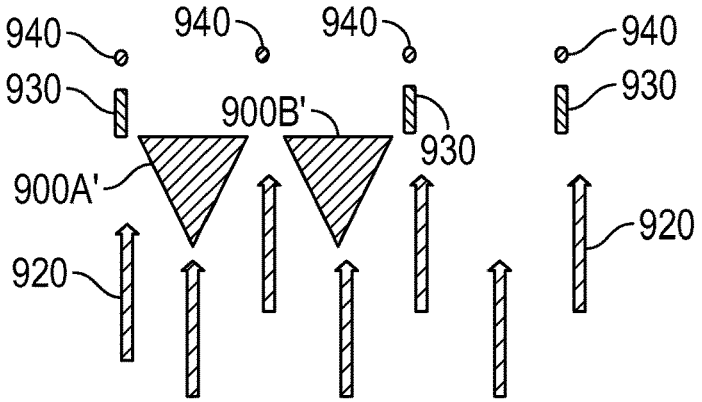
Figure 7C:
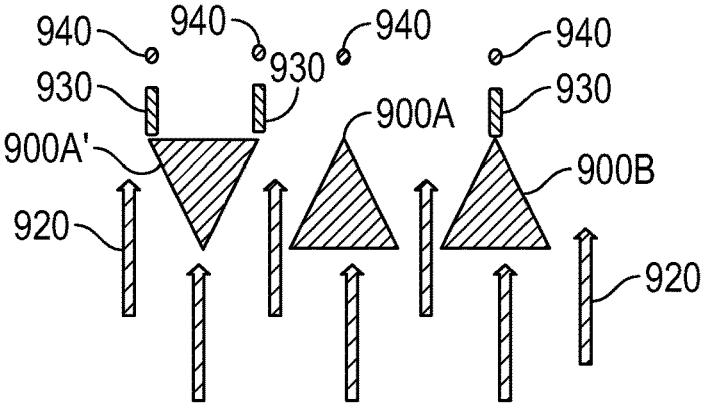

FIGS. 7A to 7C illustrate alternative positions for one or more delta wing vortex generators positioned along a wall of a fuel injector and mini-mixer system (see, e.g., fuel injector and mini-mixer system 320 of FIGS. 4 and 5), according to various embodiments of the present disclosure. As shown in FIG. 7A, according to one embodiment, at least two delta wing vortex generators (900A, 900B) are positioned along a wall of a fuel injector and mini-mixer system. As shown in this embodiment, both of the delta wing vortex generators (900A, 900B) are positioned in a manner such that an apex of the respective delta wing vortex generators (900A, 900B) is disposed downstream (e.g., aft) with respect to a direction that main mini-mixer air 920 flows. As further shown in the embodiment of FIG. 7A, one of the delta wing vortex generators 900B is positioned directly in front of an enhancement air slot 930 through which enhancement air is injected into the fuel injector and mini-mixer system. This same delta wing vortex generator 900B is further positioned in front of a fuel injection hole 940 through which fuel is injected into the fuel injector and mini-mixer system. The other delta wing vortex generator 900A of this embodiment, however, is spaced from the enhancement air slots 930 through which enhancement air is injected into the fuel injector and mini-mixer system, while also being positioned in front of another fuel injection hole 940.

FIG. 7B illustrates another embodiment for positioning two delta wing vortex generators (900A', 900B') along a wall of a fuel injector and mini-mixer system. As shown in the embodiment of FIG. 7B, each of the delta wing vortex generators (900A', 900B') is positioned in a manner such that an apex of the respective delta wing vortex generators (900A', 900B') is disposed upstream with respect to a direction that main mini-mixer air 920 flows (e.g., the delta wing vortex generators (900A', 900B') of this embodiment are positioned in an opposite direction as compared to the delta wing vortex generators (900A, 900B) of FIG. 7A). As further shown in the embodiment of FIG. 7B, each of the delta wing vortex generators (900A', 900B') is positioned in between (i) enhancement air slots 930 through which enhancement air is injected into the fuel injector and mini-mixer system, and (ii) fuel injection holes 940 through which fuel is injected into the fuel injector and mini-mixer system.

FIG. 7C illustrates yet another embodiment for positioning delta wing vortex generators (900A', 900A, 900B) along a wall of a fuel injector and mini-mixer system. As shown in the embodiment of FIG. 7C, three delta wing vortex generators (900A', 900A, 900B) are positioned along a wall of a fuel injector and mini-mixer system. One of the delta wing vortex generators 900A' is positioned in a manner such that an apex of the delta wing vortex generator 900A' is disposed upstream with respect to a direction that main mini-mixer air 920 flows. The other two delta wing vortex generators (900A, 900B), however, are positioned in a manner such that an apex of the respective delta wing vortex generators (900A, 900B) is disposed downstream (e.g., aft) with respect to a direction that main mini-mixer air 920 flows. As further shown in the embodiment of FIG. 7C, a first delta wing vortex generator 900A' is positioned such that enhancement air slots 930 and fuel injection holes 940 are disposed on each side of and in front of the respective delta wing vortex generators 900A'. A second delta wing vortex generator 900A of this embodiment is spaced from the enhancement air slots 930 through which enhancement air is injected into the fuel injector and mini-mixer system, while also being positioned in front of a fuel injection hole 940. A third delta wing vortex generator 900B of this embodiment is positioned directly in front of an enhancement air slot 930 through which enhancement air is injected into the fuel injector and mini-mixer system. This same delta wing vortex generator 900B is further positioned in front of a fuel injection hole 940 through which fuel is injected into the fuel injector and mini-mixer system. According to one embodiment, one or more of the arrangements illustrated in FIGS. 7A to 7C can be positioned along a wall of a fuel injector and mini-mixer system.

In accordance with the principles of the disclosure, a burner array comprising a fuel injector and mini-mixer system is provided that allows for hydrogen fuels (or high-hydrogen fuel mixtures) to be premixed with air sufficiently, post dump, before mean heat-release combustion occurs to produce dry, low emissions (DLE) exhaust performance in an aero, gas-turbine combustor at respective aero-derivative firing/cycle conditions. According to one embodiment of the present disclosure, the burner array comprising a fuel injector and mini-mixer (mini-mixer) system provides for hybrid lean direct injection/lean pre-mixed (LDI-LP) multiplicity.

In accordance with the principles of the disclosure, a hybrid, lean direct injection (LDI), lean premixed (LP), dry, low emissions (DLE) concept is created for high-hydrogen ($H_2$) applications (e.g., up to 100% $H_2$).

In accordance with the principles of the disclosure, a burner array is provided that creates independently fueled zones of small, fuel-injector-nozzle, mixing-element arrays (e.g., compact-flame array technology) that rapidly mix hydrogen fuel (or other highly reactive fuels) and air (at or above 50% spatial fuel-air (FAR) mixedness at mixer exit) before combusting as a plurality of small compact jet flames. According to one embodiment, a burner array can have multiple independent arrays or zones (e.g., 1, 2, 3, etc.), with each array/zone having multiple fuel-injector-nozzle, mixing-element arrays (e.g., 6, 17, 35, etc.). According to another embodiment, a combustor can have multiple burner arrays.

In accordance with the principles of the disclosure, a fuel injector and mini-mixer system is provided that creates a more center peaked fuel profile for fuel injection (e.g., fuel away from the wall of the injector) within a combustor of a gas turbine engine.

In accordance with the principles of the disclosure, an oblique-plane center injector (e.g., an axi-symmetric center-body injector) is provided that consistently prevents holding of a flame on a tip of the injector, prevents $H_2$ auto-ignition and/or flame holding, and creates an asymmetric flow field and, effectively, a much smaller downstream tip edge.

In accordance with the principles of the disclosure, flash-back and flame holding is eliminated, while running on 95% or greater $H_2$ fuel, with 45° main-fuel injection near exit oblique-plane center injector, and greater than 400 ft/sec exit bulk velocity at mixer exit.

In accordance with the principles of the disclosure, a primary (VG) enhancement feature is provided that includes delta-wing tetrahedron structures followed immediately by angled-jet air slots/holes. Each delta-wing structure produces an axial vortex pair without creating a recirculating wake. The subsequent air-jet energizes the vortex pair, while abating any potential wake structure (as insurance) created by the delta-wing structures before the respective fuel (e.g., hydrogen fuel) is injected into and/or between the respective vortex pair. According to one embodiment, the primary (VG) enhancement feature/system and/or vortex pair lifts and projects fuel away from the mixing element tube's outer wall (outside of the surface's boundary layer) and into the bulk air flow, while accelerating the mixing of air and fuel prior to entering a combustor. Thus, according to principles of the disclosure, the convergence of the plurality of vortex pairs, within a converging nozzle mixing element, creates accelerated, rapid, post-dump mixing, after the mixing element's exit and before the mixing element's mean combustion heat release.

In accordance with the principles of the disclosure, a fluid (e.g., fuel 1, fuel 2, or a diluent) is supplied to a tapered injector structure (e.g., centerbody) near the center of each nozzle mixing element. According to one embodiment, the independently controlled fluid (e.g., fuel 1, fuel 2, or a diluent) is injected into the respective nozzle mixing element through a single hole at or near the aft end (i.e., tip) of the tapered injector structure (e.g., centerbody). The injection hole intersects and breaks out of an oblique, angled plane that is cut into one side of the tapered injector structure (e.g., centerbody), extending to the aft-end or tip (see, e.g., FIG. 3 and FIG. 5). The oblique plane creates a "prefilming" surface, having high air velocity where the fuel jet emerges, which thereby eliminates or reduces flame-holding risk associated with a bluff-body tip wake. Also, the asymmetry created by the oblique-plane cut accelerates the mixing of the center-line fluid and surrounding air, via flow-field pressure imbalance.

According to one embodiment, contracting and releasing vortex pair/vortices achieves over >90% fuel-air (FAR) mixedness before mean heat release occurs (e.g., within about one hydraulic diameter (1 D_h) of mixer exit).

According to one embodiment, a lean direct injection (LDI) is created that removes auto-ignition, flash-back, and flame-holding risk of a pure, premixed burner/mixer design.

According to one embodiment, an array of compact, non-swirled flames is created via a burner array comprising a plurality of fuel injector and mini-mixer systems.

According to one embodiment, an independent center injector allows for multiple practical options, including, e.g., starting and/or supplementing with different fuel type(s), dynamics abatement for, e.g., $H_2$ fuels (flame shaping and/or heat-release shaping), and/or NOx abatement/suppression or power augmentation (using water injection).

According to one embodiment, mixer air and/or main fuel convectively cool the aft plate.

In accordance with the principles of the disclosure, hydrogen and air can be premixed at aero-derivative, gas-turbine conditions for dry low emissions, while not flashing back into, auto-igniting in, or flame holding in the premixing nozzle device.

In accordance with the principles of the disclosure, vortex-generating, mixing-enhancement features are provided to project hydrogen (fuel) away from device boundary layers and to create a specific device-exiting flow field that rapidly, thoroughly mixes the hydrogen and air outside of the device before the majority of combustion heat release.

In accordance with the principles of the disclosure, small nozzle/mixing elements are provided that include an independent centerbody injector, which allows for running a different fuel for ignition and/or no-load operation, augmenting/modifying the element's (or zone's) flame structure for abating combustion dynamics, and/or injecting a diluent (e.g., water) to further suppress NOx emissions.

In accordance with the principles of the disclosure, an aero-derivative, 100% hydrogen fueled, dry, low emissions (DLE) engine can be provided. According to embodiments of the disclosure, up to 100% hydrogen capability (zero carbon footprint) for merging with renewables can be provided, while requiring little or no water, for achieving less than 15 ppm NOx in competitive, emissions-restricted regions/markets.

Further aspects of the present disclosure are provided by the subject matter of the following clauses.

A fuel injector and mini-mixer system comprising: (a) a mixing element tube configured to mix air and fuel prior to injecting the air and fuel into a combustor, (b) an injector positioned within the mixing element tube, the injector being configured to inject a fluid into the mixing element tube, (c) one or more air inlet slots positioned on one or more sides of the injector, the one or more air inlet slots configured to inject air into the mixing element tube, (d) one or more fuel injection holes extending into the mixing element tube, the one or more fuel injection holes configured to inject fuel into the mixing element tube, and (e) one or more delta wing vortex generators positioned within an internal wall of the mixing element tube, the one or more delta wing vortex generators configured to generate a vortex pair that accelerates the mixing of the air and fuel injected into the mixing element tube.

The fuel injector and mini-mixer system of any preceding clause, wherein the injector is positioned within a center of the mixing element tube.

The fuel injector and mini-mixer system of any preceding clause, further comprising one or more air enhancement slots extending into the mixing element tube, the one or more air enhancement slots configured to inject enhancement air into the mixing element tube to of (i) energize the vortex pair or (ii) lift fuel away from the internal wall to prevent flameholding.

The fuel injector and mini-mixer system of any preceding clause, wherein the one or more air enhancement slots is disposed downstream from the one or more delta wing vortex generators.

The fuel injector and mini-mixer system of any preceding clause, wherein the one or more air enhancement slots is positioned upstream from the one or more fuel injection holes.

The fuel injector and mini-mixer system of any preceding clause, wherein the one or more fuel injection holes is at an angle relative to the one or more air enhancement slots.

The fuel injector and mini-mixer system of any preceding clause, wherein the one or more fuel injection holes is parallel to the one or more air enhancement slots.

The fuel injector and mini-mixer system of any preceding clause, wherein the one or more air enhancement slots is positioned an angle of 30° to 90° relative to the internal wall of the mixing element tube.

The fuel injector and mini-mixer system of any preceding clause, wherein the one or more fuel injection holes is positioned an angle of 30° to 90° relative to the internal wall of the mixing element tube.

The fuel injector and mini-mixer system of any preceding clause, further comprising an annular fuel distribution gallery that surrounds the mixing element tube, the annular fuel distribution gallery being configured to distribute fuel to the one or more fuel injection holes from a main fuel inlet tube.

The fuel injector and mini-mixer system of any preceding clause, wherein the injector is independently controlled with respect to the annular fuel distribution gallery that is configured to distribute fuel to the one or more fuel injection holes from the main fuel inlet tube.

The fuel injector and mini-mixer system of any preceding clause, wherein the fluid that is injected into the mixing element tube by the injector is a different type of fluid than the fuel distributed from the main fuel inlet tube.

The fuel injector and mini-mixer system of any preceding clause, wherein the fluid that is injected into the mixing element tube by the injector is at least one of natural gas fuel, $H_2$ fuel, a blend of $H_2$ fuel, and water.

The fuel injector and mini-mixer system of any preceding clause, wherein the injector extends to a tip portion having an outlet through which the fluid is injected into the mixing element tube, the tip portion being shaped at an oblique angle relative to an external surface of the injector.

The fuel injector and mini-mixer system of any preceding clause, wherein the oblique angle is from 30° to 60° relative to the external surface of the injector.

The fuel injector and mini-mixer system of any preceding clause, wherein the mixing element tube extends to a distal end, with the mixing element tube converging at the distal end.

The fuel injector and mini-mixer system of any preceding clause, wherein the one or more delta wing vortex generators comprises a front surface that is positioned at an angle of 10° to 50° relative to the internal wall of the mixing element tube.

The fuel injector and mini-mixer system of any preceding clause, wherein the one or more delta wing vortex generators comprises a front surface that extends a distance L to a back surface of the one or more delta wing vortex generators, with the back surface extending a distance H from the internal wall of the mixing element tube, wherein the distance L is from 0.5 to three times the distance H.

The fuel injector and mini-mixer system of any preceding clause, wherein the one or more delta wing vortex generators comprises a first side and a second side that are positioned at an angle $\alpha$ relative to each other, wherein the angle $\alpha$ is from 20° to 120°.

The fuel injector and mini-mixer system of any preceding clause, wherein at least one of the one or more delta wing vortex generators comprises a tetrahedron shape.

The fuel injector and mini-mixer system of any preceding clause, wherein the one or more delta wing vortex generators is configured to generate a vortex pair that includes (i) a first vortex that rotates in a first direction and (ii) a second vortex that rotates in a second direction that is opposite to the first direction.

The fuel injector and mini-mixer system of any preceding clause, wherein the one or more delta wing vortex generators comprises one or more of (i) at least one delta wing vortex generator having an apex that is disposed downstream with respect to a direction that the air flows into the mixing element tube, (ii) at least one delta wing vortex generator having an apex that is disposed upstream with respect to a direction that the air flows into the mixing element tube, (iii) at least one delta wing vortex generator that is positioned between a pair of air enhancement slots that extends into the mixing element tube, (iv) at least one delta wing vortex generator that is positioned in front of an air enhancement slot that extends into the mixing element tube, or (v) at least one delta wing vortex generator that is positioned in front of at least one of the one or more fuel injection holes.

The fuel injector and mini-mixer system of any preceding clause, wherein the one or more fuel injection holes is configured to inject hydrogen fuel into the mixing element tube.

A method of using the fuel injector and mini-mixer system of any preceding clause.

The method of using the fuel injector and mini-mixer system of any preceding clause, wherein the fluid that is injected into the mixing element tube by the injector is a different type of fluid than the fuel distributed from the main fuel inlet tube.

The method of using the fuel injector and mini-mixer system of any preceding clause wherein the fluid that is injected into the mixing element tube by the injector is at least one of natural gas fuel, $H_2$ fuel, a blend of $H_2$ fuel, and water.

The method of using the fuel injector and mini-mixer system of any preceding clause wherein hydrogen fuel is injected into the mixing element tube via the one or more fuel injection holes.

A burner array comprising: (a) a plurality of fuel injector and mini-mixer systems, each fuel injector and mini-mixer system of the plurality of fuel injector and mini-mixer systems comprising: (i) a mixing element tube configured to mix air and fuel prior to injecting the air and fuel into a combustor, (ii) an injector positioned within the mixing element tube, the injector being configured to inject a fluid into the mixing element tube, (iii) one or more air inlet slots positioned on one or more sides of the injector, the one or more air inlet slots configured to inject air into the mixing element tube, (iv) one or more fuel injection holes extending into the mixing element tube, the one or more fuel injection holes configured to inject fuel into the mixing element tube, and (v) one or more delta wing vortex generators positioned within an internal wall of the mixing element tube, the one or more delta wing vortex generators configured to generate a vortex pair that accelerates the mixing of the air and fuel injected into the mixing element tube, and (b) a plate covering the plurality of fuel injector and mini-mixer systems.

The burner array of any preceding clause, further comprising a main fuel inlet structure positioned between each fuel injector and mini-mixer system of the plurality of fuel injector and mini-mixer systems, wherein the main fuel inlet structure is configured to distribute fuel into the burner array.

The burner array of any preceding clause, further comprising a channel that couples the main fuel inlet structure with each fuel injector and mini-mixer system of the plurality of fuel injector and mini-mixer systems.

The burner array of any preceding clause, further comprising a plurality of cooling holes configured to control a temperature of the burner array.

The burner array of any preceding clause, wherein the burner array comprises one or more independently controlled arrays, with each array of the one or more independently controlled arrays comprising a plurality of the fuel injector and mini-mixer systems.

A method of using the burner array of any preceding clause.

A combustor comprising: (A) an internal wall and an external wall, the internal wall having a burner array, the burner array comprising: (a) a plurality of fuel injector and mini-mixer systems, each fuel injector and mini-mixer system of the plurality of fuel injector and mini-mixer systems comprising: (i) a mixing element tube configured to mix air and fuel prior to injecting the air and fuel into a combustor, (ii) an injector positioned within the mixing element tube, the injector being configured to inject a fluid into the mixing element tube, (iii) one or more air inlet slots positioned on one or more sides of the injector, the one or more air inlet slots configured to inject air into the mixing element tube, (iv) one or more fuel injection holes extending into the mixing element tube, the one or more fuel injection holes configured to inject fuel into the mixing element tube, and (v) one or more delta wing vortex generators positioned within an internal wall of the mixing element tube, the one or more delta wing vortex generators configured to generate a vortex pair that accelerates the mixing of the air and fuel injected into the mixing element tube, and (b) a plate covering the plurality of fuel injector and mini-mixer systems, and (B) a chamber configured to combust the air and fuel injected into the combustor via the burner array.

The combustor of any preceding clause, wherein the burner array further comprises a main fuel inlet structure positioned between each fuel injector and mini-mixer system of the plurality of fuel injector and mini-mixer systems, wherein the main fuel inlet structure is configured to distribute fuel into the burner array.

The combustor of any preceding clause, wherein the burner array further comprises a channel that couples the main fuel inlet structure with each fuel injector and mini-mixer system of the plurality of fuel injector and mini-mixer systems.

The combustor of any preceding clause, wherein the burner array further comprises a plurality of cooling holes configured to control a temperature of the burner array.

The combustor of any preceding clause, wherein the burner array comprises one or more independently controlled arrays, with each array of the one or more independently controlled arrays comprising a plurality of the fuel injector and mini-mixer systems.

A method of using the combustor of any preceding clause.

Although the foregoing description is directed to the preferred embodiments, it is noted that other variations and modifications will be apparent to those skilled in the art, and may be made without departing from the spirit or scope of the disclosure Moreover, features described in connection with one embodiment may be used in conjunction with other embodiments, even if not explicitly stated above.

The invention claimed is:

1. A fuel injector and mini-mixer system comprising:

(a) a mixing element tube configured to mix air and fuel prior to injecting the air and fuel into a combustor;

(b) an injector positioned within the mixing element tube, the injector being configured to inject a fluid into the mixing element tube;

(c) one or more air inlet slots positioned on one or more sides of the injector, the one or more air inlet slots configured to inject air into the mixing element tube;

(d) one or more fuel injection holes extending into the mixing element tube, the one or more fuel injection holes configured to inject fuel into the mixing element tube; and (e) one or more delta wing vortex generators positioned within an internal wall of the mixing element tube, the one or more delta wing vortex generators configured to generate a vortex pair that accelerates the mixing of the air and fuel injected into the mixing element tube.

2. The fuel injector and mini-mixer system according to claim 1, further comprising one or more air enhancement slots extending into the mixing element tube, the one or more air enhancement slots configured to inject enhancement air into the mixing element tube to (i) energize the vortex pair or (ii) lift fuel away from the internal wall to prevent flameholding.

3. The fuel injector and mini-mixer system according to claim 2, wherein the one or more air enhancement slots is disposed (i) downstream from the one or more delta wing vortex generators, and (ii) upstream from the one or more fuel injection holes.

4. The fuel injector and mini-mixer system according to claim 3, wherein the one or more fuel injection holes is at an angle relative to the one or more air enhancement slots.

5. The fuel injector and mini-mixer system according to claim 3, wherein the one or more fuel injection holes is parallel to the one or more air enhancement slots.

6. The fuel injector and mini-mixer system according to claim 2, wherein the one or more air enhancement slots is positioned at an angle of 30° to 90° relative to the internal wall of the mixing element tube, and wherein the one or more fuel injection holes is positioned at an angle of 30° to 90° relative to the internal wall of the mixing element tube.

7. The fuel injector and mini-mixer system according to claim 1, further comprising an annular fuel distribution gallery that surrounds the mixing element tube, the annular fuel distribution gallery being configured to distribute fuel to the one or more fuel injection holes from a main fuel inlet tube.

8. The fuel injector and mini-mixer system according to claim 7, wherein the injector is independently controlled with respect to the annular fuel distribution gallery that is configured to distribute fuel to the one or more fuel injection holes from the main fuel inlet tube.

9. The fuel injector and mini-mixer system according to claim 1, wherein the injector extends to a tip portion having an outlet through which the fluid is injected into the mixing element tube, the tip portion being shaped at an oblique angle relative to an external surface of the injector.

10. The fuel injector and mini-mixer system according to claim 9, wherein the oblique angle is from 30° to 60° relative to the external surface of the injector.

11. The fuel injector and mini-mixer system according to claim 1, wherein the mixing element tube extends to a distal end, with the mixing element tube converging at the distal end.

12. The fuel injector and mini-mixer system according to claim 1, wherein the one or more delta wing vortex generators comprises a front surface that is positioned at an angle of 10° to 50° relative to the internal wall of the mixing element tube, and wherein the one or more delta wing vortex generators comprises a first side and a second side that are positioned at an angle $\alpha$ relative to each other, with the angle $\alpha$ being from 20° to 120°.

13. The fuel injector and mini-mixer system according to claim 1, wherein the one or more delta wing vortex generators comprises a front surface that extends a distance L to a back surface of the one or more delta wing vortex generators, with the back surface extending a distance H from the internal wall of the mixing element tube, wherein the distance L is from 0.5 to three times the distance H.

14. The fuel injector and mini-mixer system according to claim 1, wherein at least one of the one or more delta wing vortex generators comprises a tetrahedron shape.

15. The fuel injector and mini-mixer system according to claim 1, wherein the one or more delta wing vortex generators is configured to generate a vortex pair that includes (i) a first vortex that rotates in a first direction and (ii) a second vortex that rotates in a second direction that is opposite to the first direction.

16. The fuel injector and mini-mixer system according to claim 1, wherein the one or more delta wing vortex generators comprises one or more of (i) at least one delta wing vortex generator having an apex that is disposed downstream with respect to a direction that the air flows into the mixing element tube, (ii) at least one delta wing vortex generator having an apex that is disposed upstream with respect to a direction that the air flows into the mixing element tube, (iii) at least one delta wing vortex generator that is positioned between a pair of air enhancement slots that extends into the mixing element tube, (iv) at least one delta wing vortex generator that is positioned in front of an air enhancement slot that extends into the mixing element tube, or (v) at least one delta wing vortex generator that is positioned in front of at least one of the one or more fuel injection holes.

17. The fuel injector and mini-mixer system according to claim 1, wherein the one or more fuel injection holes is configured to inject hydrogen fuel into the mixing element tube.

18. A burner array comprising:

(a) a plurality of fuel injector and mini-mixer systems, each fuel injector and mini-mixer system of the plurality of fuel injector and mini-mixer systems comprising:

(i) a mixing element tube configured to mix air and fuel prior to injecting the air and fuel into a combustor;

(ii) an injector positioned within the mixing element tube, the injector being configured to inject a fluid into the mixing element tube;

(iii) one or more air inlet slots positioned on one or more sides of the injector, the one or more air inlet slots configured to inject air into the mixing element tube;

(iv) one or more fuel injection holes extending into the mixing element tube, the one or more fuel injection holes configured to inject fuel into the mixing element tube; and (v) one or more delta wing vortex generators positioned within an internal wall of the mixing element tube, the one or more delta wing vortex generators configured to generate a vortex pair that accelerates the mixing of the air and fuel injected into the mixing element tube; and (b) a plate covering the plurality of fuel injector and mini-mixer systems.

19. The burner array according to claim 18, wherein the burner array comprises one or more independently controlled arrays, with each array of the one or more independently controlled arrays comprising a plurality of the fuel injector and mini-mixer systems.

20. A combustor comprising:

(A) an internal wall and an external wall, the internal wall having a burner array, the burner array comprising:

(a) a plurality of fuel injector and mini-mixer systems, each fuel injector and mini-mixer system of the plurality of fuel injector and mini-mixer systems comprising:

(i) a mixing element tube configured to mix air and fuel prior to injecting the air and fuel into the combustor;

(ii) an injector positioned within the mixing element tube, the injector being configured to inject a fluid into the mixing element tube;

(iii) one or more air inlet slots positioned on one or more sides of the injector, the one or more air inlet slots configured to inject air into the mixing element tube;

(iv) one or more fuel injection holes extending into the mixing element tube, the one or more fuel injection holes configured to inject fuel into the mixing element tube; and (v) one or more delta wing vortex generators positioned within an internal wall of the mixing element tube, the one or more delta wing vortex generators configured to generate a vortex pair that accelerates the mixing of the air and fuel injected into the mixing element tube; and (b) a plate covering the plurality of fuel injector and mini-mixer systems; and (B) a chamber configured to combust the air and fuel injected into the combustor via the burner array.

* * * * *